US009579904B1

(12) United States Patent
Stowe et al.

(10) Patent No.: US 9,579,904 B1
(45) Date of Patent: Feb. 28, 2017

(54) SYSTEM AND METHOD FOR THERMAL TRANSFER OF THICK METAL LINES

(71) Applicant: PALO ALTO RESEARCH CENTER INCORPORATED, Palo Alto, CA (US)

(72) Inventors: Timothy D. Stowe, Alameda, CA (US); Gregory Lewis Whiting, Menlo Park, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 0 days.

(21) Appl. No.: 14/985,098

(22) Filed: Dec. 30, 2015

(51) Int. Cl.
*B41J 2/325* (2006.01)
*B41J 2/44* (2006.01)
*B41J 33/14* (2006.01)

(52) U.S. Cl.
CPC ..... *B41J 2/442* (2013.01); *B41J 33/14* (2013.01)

(58) Field of Classification Search
CPC .. B41F 16/00; B41F 16/0006; B41F 16/0026; B41F 16/0033; B41J 2/315; B41J 2/32; B41J 2/325
See application file for complete search history.

(56) References Cited

U.S. PATENT DOCUMENTS 6,350,071 B1 * 2/2002 Conwell ..... B41J 2/325 400/120.18
6,476,842 B1 * 11/2002 Chang ..... B41J 2/325 347/217
6,894,713 B2 * 5/2005 Moulin ..... B41J 2/325 347/262

OTHER PUBLICATIONS

Yoo et al., "Parallelized laser-direct patterning of nanocrystalline metal thin films by use of a pulsed laser-induced thermo-elastic force," Nanotechnology 20 pp. 1-6 (IOP Pub. Ltd., May 26, 2009).

* cited by examiner

*Primary Examiner* — Kristal Feggins
(74) *Attorney, Agent, or Firm* — Prass LLP

(57) ABSTRACT

A system for transferring a marking material from a ribbon to a substrate is provided. The ribbon has a marking material and a tie layer. The system includes a ribbon take-up device; a ribbon supply source that supplies the ribbon to the ribbon take-up device such that the ribbon is moved in a process direction; a first laser beam source configured to project a laser beam onto the ribbon to define an edge outline to a pattern of a marking portion of the marking material of the ribbon, the marking portion being a portion of the marking material of the ribbon that is to be transferred to the substrate, the first laser beam source being configured to create a weakening of the edge outline; and a heating unit configured to melt the tie layer of the ribbon at the marking portion, the melting taking place at a location where the ribbon is in contact with the substrate, the heating unit being configured to melt the tie layer such that the marking portion transfers to the substrate.

20 Claims, 8 Drawing Sheets

SYSTEM AND METHOD FOR THERMAL TRANSFER OF THICK METAL LINES

BACKGROUND

Disclosed herein are systems and methods for transferring a marking material from a ribbon to a substrate.

Embodiments of the disclosure are well suited for transferring thick metallic foils and other materials from a ribbon to a substrate using a digitally addressable laser.

SUMMARY

Transferring a portion of a metallic (or other) ribbon to a substrate to form a patterned metal (or other) layer of marking material is useful in various products and materials.

Thin continuous metal films can be transferred to substrates via thermal transfer over (TTO) printing using a thermal resist head array. An example of such a device is shown in FIG. 1. The head 110 is brought into contact with a thermal transfer ribbon 130. Ribbon 130 has a geometric structure that when heated, promotes the transfer of the metal film via adhesion layers and release layers. As shown in FIG. 1, after head 110 selectively heats portions of ribbon 130, a marking portion (for example, a metalized layer) 120 of ribbon 130 separates from a film 100 and adheres to a substrate 150. The ribbon can have a structure as shown in FIG. 2. FIG. 2 shows a ribbon 200 having a heat resistant coating 210, a PET substrate 220, a conductive release layer 230, a vacuum metalized layer 240 and a thermoplastic tie layer 250.

To obtain a metal pattern, a thermal head melts the thermoplastic tie layer creating pattern-wise adhesion to the substrate. The adhesion strength of the tie layer must be high enough to allow the metal layer to shear when the ribbon is released from the substrate. During this time, shear stresses at an adhesion edge break the edge of the metal film without compromising adhesion. This means thin metals such as aluminum are easier to use because it is very difficult to break thick metal films cleanly without compromising the adhesion. More ductile metals such as copper must be laid down still thinner than aluminum as such metals tend to not break as easily as aluminum. Typical thicknesses of the metalized layer are limited to about 0.5 microns or thinner even for the case of aluminum. Thus thin submicron continuous metal structures can be patterned over a variety of flat substrates without the need for evaporating a solvent or sintering of metal particles which is advantageous in terms of process control, thin film conductivity, and substrate compatibility. Additionally, the surface quality of these metal films is free of voids and surface roughness typically associated with inkjets and sintering. Such defects often lead to enhanced Ohmic losses due to skin conduction losses at high frequencies such as UHF RFID (300 MHz). These losses are often not detected when doing simple 4-point probe measurements. Finally, this process lends itself to very fine control over conductor linewidths at or below 100 microns.

Unfortunately there are many other high volume applications where thicker metal must be used for adequate performance. For example, printed circuit boards (PCB) typically use much thicker layers in order to handle high power and current requirements. Copper metal thicknesses of 25 microns are very common in PCBs to allow for adequate current supply to the whole board. Solid metal films this thick cannot be printed with TTO because there is not enough adhesion of the tie layer to shear the metal apart.

For many, it would be very desirable to be able to create complex printed circuit boards without needing to employ an outside board maker, but instead, quickly print and prototype single boards in-house, thus lowering the cost and turn-around time for PCB fabrication. TTO is attractive because no toxic or complex chemistry is needed to form metal patterns. However, because it requires thin metal lines (especially in the case of copper), this put limits on the design of the board as power and ground lines using TTO are too thin for most applications.

In order for this sector to be addressed with TTO technology, a new ribbon structure is needed that allows thicker layers of metal yet provides some of the various advantages of TTO, such as the surface smoothness quality for low resistive skin losses in the GHz frequency range.

Single pass imaging using rapidly addressable laser lamination is a way to perform hot transfer stamping or hot foil printing in a digital fashion at much higher speeds than can currently be done with resistive thermal heads.

Besides PCBs, an example of a product that can take advantage of embodiments of the disclosure is chipless RFID labels. One of the problems with the adoption of chipless RFID is that the RFID labels need to be applied and encoded (with variable data antenna structures) at high speed while the labels are being printed. Other applications of high speed foil transfer include security printing and decorative short run variable data printing at speeds greater than 0.5 m/s.

Embodiments of the disclosure provide a solution to the above problems. Embodiments of the disclosure apply pressure to a ribbon by pressing it between a pressure roller and a substrate and then directing a digitally addressable laser to the pressure location. Metallic foil ribbons require more energy to properly transfer to a substrate for at least the reason that metal spreads heat more quickly than many other materials, such as plastics, do. This is especially true for relatively thick metallic foils. The laser heating sources of embodiments of the disclosure provide a higher energy that provides a higher quality transfer.

An example of an appropriate laser for use in embodiments of the disclosure is an imaging (e.g., lithographic) apparatus including two or more spatial light modulators and associated anamorphic optical systems that modulate homogenous light and form anamorphically imaged in the process and cross-process directions, and concentrated (converged or linearly-focused) light fields in a substantially one-dimensional imaging region on a targeted scan structure (e.g., a drum roller). Each spatial light modulator (e.g., digital micromirror (DMD) devices, electro-optic diffractive modulator arrays, or arrays of thermo-optic absorber elements) includes individually addressable elements having light modulating structures that modulate (e.g., either passes or impedes/redirects) associated portions of the homogenous light according to predetermined image data. Each anamorphic optical system images and concentrates the modulated homogenous light received from an associated spatial light modulator to form an associated scan line portion, and the scan line portions formed by each anamorphic optical system collectively form the elongated scan line in the imaging region of the scan structure. Here the term anamorphic optical system refers to any system of optical lens, mirrors, or other elements that project the light from an object plane such as a pattern of light formed by a spatial light modulator, to a final imaging plane with a differing amount of magnification along orthogonal directions. Thus, for example, a square-shaped imaging pattern formed by a 2D spatial light modulator could be anamorphically projected so as to magnify its width and at same time demagnify (or bring to a concentrated focus) its height thereby transforming square shape into an image of an extremely thin elongated rectangular shape at the final image plane. By utilizing the anamorphic optical system to concentrate the modulated homogenous light, high total optical intensity (flux density) (i.e., on the order of hundreds of Watts/cm.sup.2) can be generated on any point of the scan line image without requiring a high intensity light source pass through a spatial light modulator, thereby facilitating a reliable yet high power imaging system. Furthermore, it should be clarified that the homogenous light generator, may include multiple optical elements such as light pipes or lens arrays, that reshape the light from one or more non-uniform sources of light so as to provide substantially uniform light intensity across at least one dimension of a two-dimensional light field.

Embodiments of the disclosure provide systems and methods of transferring at a high speed marking material from a ribbon to a substrate using digitally addressable lasers.

Embodiments of the disclosure address the problem associated with thick metallic layers of marking material by weakening an edge outline of the marking material before the marking material is applied to the substrate. By weakening the edge outline, i.e. creating etch edge cracks or voids that predefine a perforated outline in the continuous marking material, the portion that is to adhere to the substrate more easily separates from the remaining portion of the ribbon.

An embodiment of the disclosure may include a system for transferring a marking material from a ribbon to a substrate, the ribbon having a marking material and a tie layer. The system includes a ribbon take-up device; a ribbon supply source that supplies the ribbon to the ribbon take-up device such that the ribbon is moved in a process direction; a first laser beam source configured to project a laser beam onto the ribbon to define an edge outline to a pattern of a marking portion of the marking material of the ribbon, the marking portion being a portion of the marking material of the ribbon that is to be transferred to the substrate, the first laser beam source being configured to create a weakening of the edge outline; and a heating unit configured to melt the tie layer of the ribbon at the marking portion, the melting taking place at a location where the ribbon is in contact with the substrate, the heating unit being configured to melt the tie layer such that the marking portion transfers to the substrate.

Another embodiment of the disclosure may include a method of transferring a marking material from a ribbon to a substrate, the ribbon having a marking material and a tie layer. The method includes supplying a ribbon from a supply source to a ribbon take-up device such that the ribbon is moved in a process direction; projecting a laser beam from a first laser beam source onto the ribbon to define an edge outline to a pattern of a marking portion of the marking material of the ribbon, the marking portion being a portion of the marking material of the ribbon that is to be transferred to the substrate, the first laser beam source creating a mechanical weakening of the edge outline; and a heating unit for melting the tie layer of the ribbon at the marking portion, the melting taking place at a location where the ribbon is in contact with the substrate, the heating unit melting the tie layer such that the marking portion transfers to the substrate.

Some embodiments also include the heating unit and the first laser beam source being located at different locations in the process direction.

Some embodiments may include a pressure roll located between the ribbon supply source and the ribbon take-up device in the process direction, the pressure roll being configured to apply pressure to the ribbon at a pressure location when the ribbon is positioned between the pressure roll and the substrate.

Some embodiments may include the heating unit being a second laser beam source that directs a plurality of laser beams through the pressure roll and onto the ribbon at the pressure location.

Some embodiments may include the second laser beam source being a digitally addressable laser beam source that is stationary in a direction perpendicular to the process direction.

Some embodiments may include the marking material of the ribbon being a metal film that is under tensile stress when the ribbon passes by the first laser beam source, and the first laser beam source being configured to rapidly shock the metal film along the edge outline such that the marking portion separates via edge cracking of the material from a remaining portion of the marking material, the remaining portion of the marking material being that portion of the marking material that is not the marking portion transferred to the substrate.

Some embodiments include the metal film being greater than or equal to 0.3 micrometers thick.

Some embodiments include the marking material of the ribbon being a metallic paste matrix having metallic particles dispersed within a binder, the binder having a melting temperature that is higher than or equal to a melting temperature of the tie layer, and the first laser beam source being configured to melt the binder along the edge outline such that the marking portion separates from a remaining portion of the marking material, the remaining portion of the marking material being that portion of the marking material that is not the marking portion transferred to the substrate.

DETAILED DESCRIPTION

Figure 1:
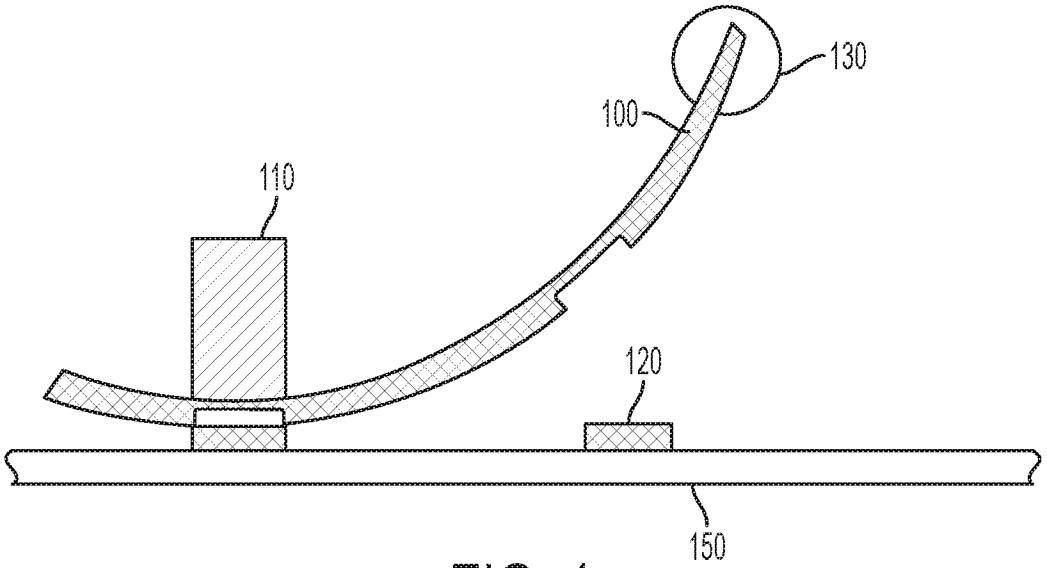
FIG. 1 is a schematic view of process by which a transfer is made from a ribbon.
Figure 2:
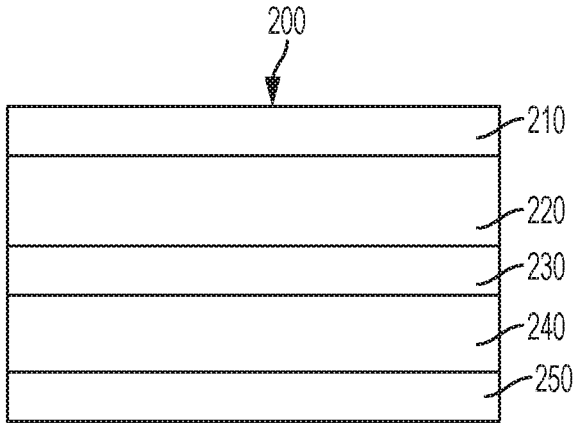
FIG. 2 is a schematic sectional view of an example of a ribbon in accordance with embodiments of the disclosure.

Two exemplary embodiments of the disclosure will be described below. Both of the two embodiments share a common thread as they both pre-define the edge definition of the metal marking material (film) and the film is mechanically weakened at these edges before metal film transfer to the substrate occurs.

A base ribbon supporting material can be made from an optically clear polyethylene terephthalate PET or polyester mylar film. To this film an absorption layer can be constructed having an infrared absorbing dye or pigment. Examples include carbon black or NIR absorbing dyes that are commercially available which are predispersed in a polymer resin and coated as a thin layer on top of the top supporting film.

An optional release layer is one that de-bonds upon the thermal absorption of the layer and could be made from gas-producing polymers including, but not limited to, nitrocellulose materials or thermally decomposable polycarbonates deposited using various coating methods including, but not limited to, gravure.

An example of a thick metal ribbon material is one with CuO nano particles at approximately 80% by weight that is held together with a binding matrix of Cyclododecane wax. Such nanoparticles have reduced melting temperatures and can be engineered in formulations to be photonically cured by the pulsed forge method developed by the company Novacentrix. Such particles can be engineered to be dispersible in aqueous or solvent based solutions and supplied as pasted flexo or screen printable formulations that make them easily miscible with a variety of binding agents and capable of being deposited uniformly onto a thermal transfer ribbon.

The final tie (adhesion) layer which yields increased adhesion to a substrate based upon the laser exposure can be made from a hot melt adhesive or thermoplastic resin with improved adhesion upon heating. This layer can be made thin enough that it is porous and permeable and allows sublimated cyclododecane to easily permeate through it in a gaseous phase.

During edge weakening formation with a pulsed laser, the laser power is presented before the metal transfer ribbon is in contact with the substrate and therefore by pulsing the laser and raising its temperature along the edges of the pattern to be transferred, the cyclododecane sublimates at around 65-100 C and escapes through the porous adhesion layer, greatly weakening the edges of the metallic layer to be transferred and allowing for easier separation from the carrier ribbon.

Another exemplary construction would be to use a standard metallic layer on a thermal transfer ribbon such as provided by IIMAK located in Amherst N.Y. known as Metallograph® Conductive Thermal Transfer Ribbon.

By pulsing a laser at the edge of the metal film, a pattern can be defined before transfer by using a pulsed laser to pre-fractured or pre-shear the metal along grain boundaries according to patterning techniques using pulsed laser induced thermal elastic shock.

The film deposition parameters can be tuned empirically to provide built in tensile stress and grain sizes that help reduce the necessary laser power to pre-weaken the transfer pattern edges.

An example of the laser shock absorption method is discussed in Parallelized Laser-direct Patterning of Nanocrystalline Metal Thin Films by Use of a Pulsed Laser-induced Thermo-elastic Force (*Nanotechnology*. 2009 Jun. 17; Yoo H, Shin H, Sim B, Kim S, Lee M.). Thin film patterning by the conventional lithographic technique requires a number of steps including the deposition, development, and removal of the photoresist layer. Here it is demonstrated that metal thin films evaporated on glass can be directly patterned by a spatially modulated pulsed Nd-YAG laser beam (wavelength=1064 nm, pulse width=6 ns) incident from the backside of the substrate. This method utilizes a pulsed laser-induced thermo-elastic force exerted on the film which plays a role in detaching it from the substrate. High-fidelity patterns at the micrometer scale have been fabricated over a few square centimeters by a single pulse with pulse energy of 850 mJ. This is attributed to the fact that deposited metal films are polycrystalline with nano-sized grains, and thus localized etching of the material is possible with shearing along the weakly bonded grain boundary regions. The authors have also developed a nano-block model to simulate the laser-direct patterning of nanocrystalline thin films. The patterning process presented here provides a simple photoresist-free route to fabricate metal thin film patterns on transparent substrates.

In a first embodiment of the disclosure, a thick tensile stressed metal film is used as the marking portion of the ribbon. This approach uses the same standard structure of a continuous metal ribbon film. However the film is put down in a tensile stress state when the ribbon is manufactured. When controlling the deposition parameters during evaporation or electroplating metallization, it is possible to control the mechanical stress of thin films. Cracked metal from electroplating problems can be a problem. By precisely controlling the metal stresses during deposition, a tensile film can be applied that while highly stressed is still below the stress threshold necessary for spontaneous cracking.

In order to facilitate pattern-wise edge definition of the patterned transferred film through its thickness, rapid thermal shock is applied to define patterned edges of the metal film. Rapid thermal shock can be obtained using a laser induced thermal transfer system. Typical resistive element thermal heads are limited in the amount of power they can generate over a given area without compromising the head life. Also, this thermal energy must first pass its heat through a thick carrier layer such as PET, thus diluting the strength and time-compression of the electrical pulse.

By pulsing lasers (for example a galvo-based fiber, solid state YAG, or CO2 laser), a rapid thermal shock can be used to pattern-wise crack a thick metal pattern along pre-defined edges where one would like the metal film to break apart. In addition, a system implementing single pass imaging using rapidly addressable laser lamination (described below) allows for power density levels at least 10× times higher than regular thermal heads and approximately 10 times lower diffusion times.

Once these crack edge propagation points are formed, a lower amount of laser power in a continuous wave (CW) mode can be used to activate and melt the tie layer in the middle area between these edges while the metal film is in contact with a receiving substrate. This CW mode can also activate an optional temperature sensitive release layer. Heat is confined laterally inside the thicker metal provided the mechanical cracks at the edges reduce thermal conduction laterally. Because the edges of the trace are pre-defined by higher power laser edge pulses, a thick layer of metal of a desired shape can then be transferred. Here too, a single pass imaging using rapidly addressable laser lamination approach can provide the thermal energy necessary for thicker films.

In a second embodiment of the disclosure, instead of a thick stressed metal film a metal (such as, for example, copper) paste matrix with metal nano-particles dispersed inside a wax or other binder is used as the marking material in the ribbon. The binder has a sublimation point that is higher than or equal to the melting temperature of the tie layer such that the matrix can be transferred onto a substrate without first fusing this layer. In particular embodiments, the middle metal layer can be structurally held in place between a top vacuum evaporated metal layer if desired to give one side higher smoothness. A waxy based binder such as cyclododecane could be used as the matrix binding agent with clean low temperature sublimation properties.

One approach of this second embodiment is to melt the tie layer and metal paste simultaneously such that the metal is both sintered and transferred simultaneously. Because the binder matrix has little structural integrity once melted, and re-solidified, thicker metal layers can be transferred if they fuse preferentially to the substrate and themselves. However, the waxy (or high MW solvent) binder has no path to escape under this scenario unless predetermined escape paths are patterned as this approach may require CW laser power during pressure contact with the substrate.

Due to the complexity of the simultaneous melting of the tie layer and the metal paste, a more controlled 2-3 step approach may be used.

A second approach is to first melt the binder at edges of the defined pattern with laser pulses, thus weakening the metal matrix binder along those edges. This could be done before the film is in contact with the substrate so that a path for the binder to sublimate and escape is available. These pulses would raise the temperature to melt the binder but be well below the actual sintering temperature. While these laser pulses may compromise the tie and release layers at the edges, the thermal energy is pulsed at a short enough time scale (10 s of nanoseconds) that thermal diffusion is still on the 10 micron scale so it does not spread far laterally (less than 100 microns) and compromise these layers at the center of the trace desired to transfer.

Next, a lower temperature CW laser step is applied to heat the bulk pattern of the defined layer for transfer in contact with the substrate. This step activates the tie and release layers. With the edge of the metal film already weakened, the thick metal matrix film will transfer completely in its desired shape.

The last step is to then to raise the temperature of the already transferred matrix to a high enough level that the binder matrix sublimates and the metallic particles fuse. This could be accomplished, for example, by laser sintering or using UV pulse forge techniques.

While this second embodiment, as compared to the first embodiment, will likely produce a metal film less than bulk density and therefore electrical conductivity, it allows more materials freedom during the manufacturing of the metal film on a carrier substrate. The film can be applied using screen printing or doctoring processes at low temperatures without any residual mechanical stress. The metallic matrix is likely to have much higher metal loading than could be obtained by inkjet, for example, and is therefore advantageous towards the creation of dense metal films.

As stated above, both of the two embodiments share a common thread as they pre-define the edge definition of the metal marking material (film) and the film is mechanically weakened at these edges before metal film transfer to the substrate occurs.

This edge weakening process utilizes laser pulses to pre-define the edges. While the tie and release layers may be compromised during this edge definition process at these edges, the thermal energy is confined laterally due to the short thermal duration of a laser pulse and its direct absorption into the metal instead of the need to be transferred thermally through the carrier substrate.

For each of these approaches a small amount of absorber such as carbon black can be added into the thermal release layer to assist in more efficient laser absorption at a specific wavelength. The materials and techniques envisioned in this disclosure are not be limited in any respect to specific materials or metals.

Figure 3:
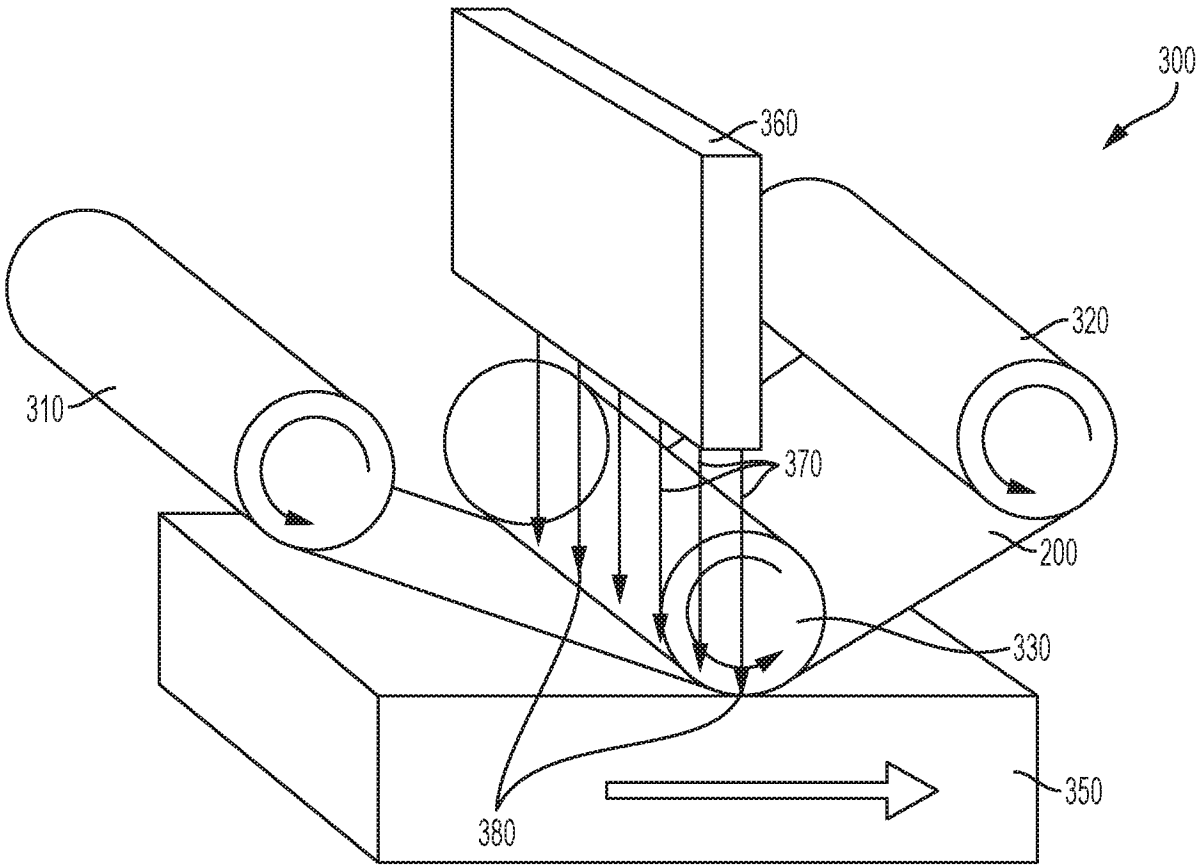
FIG. 3 is a perspective view of an example of a system in accordance with embodiments of the disclosure.

FIG. 3 shows an example of a system 300 utilizing single pass imaging using rapidly addressable laser lamination. System 300 transports ribbon 200 from a supply roll 310 to a take-up roll 320. Between supply roll 310 and take-up roll 320, ribbon 200 passes between a pressure roll 330 and a substrate 350. Substrate 350 is the product or surface onto which the marking material is transferred. As mentioned above, an example of substrate 350 is a chipless RFID label.

Ribbon 200 is subjected to pressure between pressure roll 330 and substrate 350 at nip or pressure location 380. A laser array 360 is positioned above pressure roll 330 such that laser beams 370 are projected through pressure roll 330 and onto ribbon 200 at nip 380. In order for laser beams 370 to reach nip 380, pressure roll 330 must be laser clear. In some embodiments, pressure roll 330 is a clear optical glass cylinder with a clear silicone outer layer. An example of appropriate lasers are arrayed DLP lasers with a resolution of 1200 dpi, a power of approximately 160 W, and wavelengths of approximately 400 nm, 975 nm or 1064 nm. Line speeds of approximately 1 m/s to 5 m/s are possible with embodiments of the disclosure.

Figure 4:
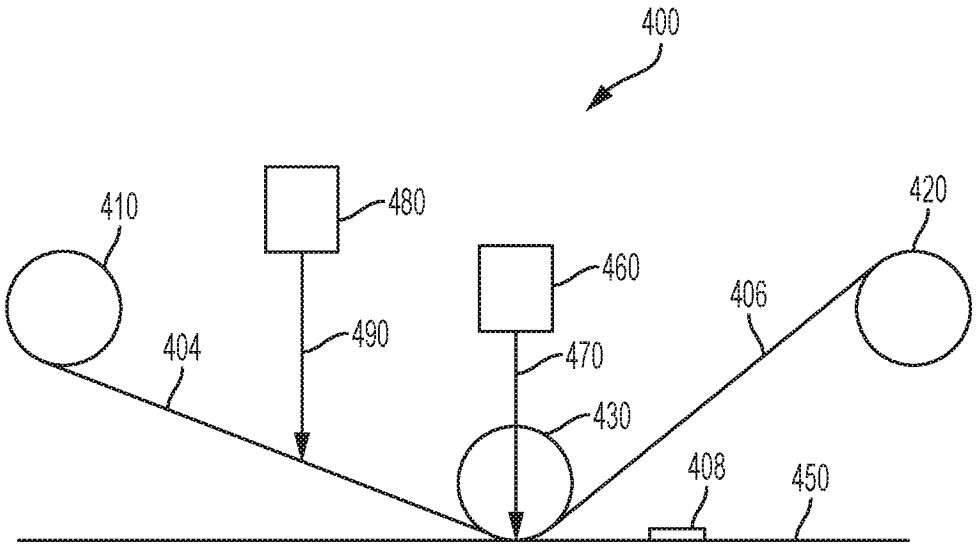
FIG. 4 is a schematic view of an example of a system in accordance with embodiments of the disclosure.

FIG. 4 shows an example 400 of the first embodiment discussed above. Similarly to FIG. 3, the system in FIG. 4 has a ribbon supply roll 410 that supplies a ribbon 404, 406 to a ribbon take-up roll 420. The ribbon is pinched between a pressure roll 430 and the substrate 450 onto which the marking material is deposited. A laser array 460 is positioned above pressure roll 430 such that laser beams 470 are projected through pressure roll 430 and onto ribbon 404 at a nip. In order for laser beams 470 to reach the nip, pressure roll 430 must be laser clear. In some embodiments, pressure roll 430 is a clear optical glass cylinder with a clear silicone outer layer.

A pulsed laser 480 projects laser pulses 490 onto ribbon 404 to crack the edges of the pattern around the portion of marking material that is to be deposited on substrate 450 ("marking portion").

Laser array 460 then heats the tie layer and the marking portion 408 adheres to substrate 450. Reference number 406 represents the ribbon after marking portion 408 is removed from the ribbon.

Figure 5:
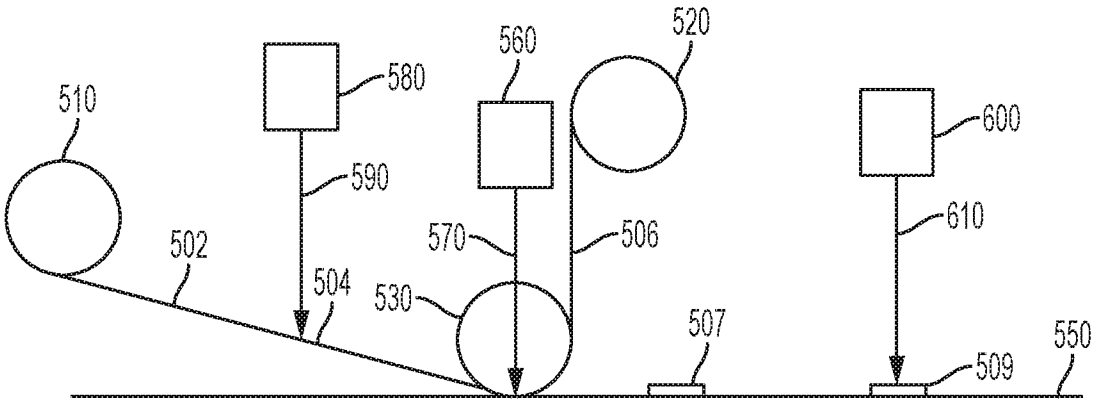
FIG. 5 is a schematic view of an example of a system in accordance with embodiments of the disclosure.

FIG. 5 shows an example 500 of the second embodiment discussed above. Similarly to the system in FIG. 4, the system in FIG. 5 has a ribbon supply roll 510 that supplies a ribbon 502, 504, 506 to a ribbon take-up roll 520. The ribbon is pinched between a pressure roll 530 and the substrate 550 onto which the marking material is deposited. A laser array 560 is positioned above pressure roll 530 such that laser beams 570 are projected through pressure roll 530 and onto ribbon 504 at a nip. In order for laser beams 570 to reach the nip, pressure roll 530 must be laser clear. In some embodiments, pressure roll 530 is a clear optical glass cylinder with a clear silicone outer layer.

A pulsed laser 580 projects laser pulses 590 onto ribbon 502 to melt the edges of the pattern around the portion of marking material that is to be deposited on substrate 550 ("marking portion").

Laser array 560 then heats the tie layer and the marking portion 507 adheres to substrate 550. Reference number 506 represents the ribbon after marking portion 507 is removed from the ribbon.

Marking portion 507 is then subjected to IR laser sintering techniques or UV PulseForge® techniques as disclosed by Novacentrix of Austin Tex., for example, to raise the temperature of the already transferred matrix to a high enough level that the binder matrix sublimates and the metallic particles fuse to form the final marking portion 509. In this example, a laser 600 projects a laser beam 610 on marking portion 507 to produce final marking portion 509.

Figure 6:
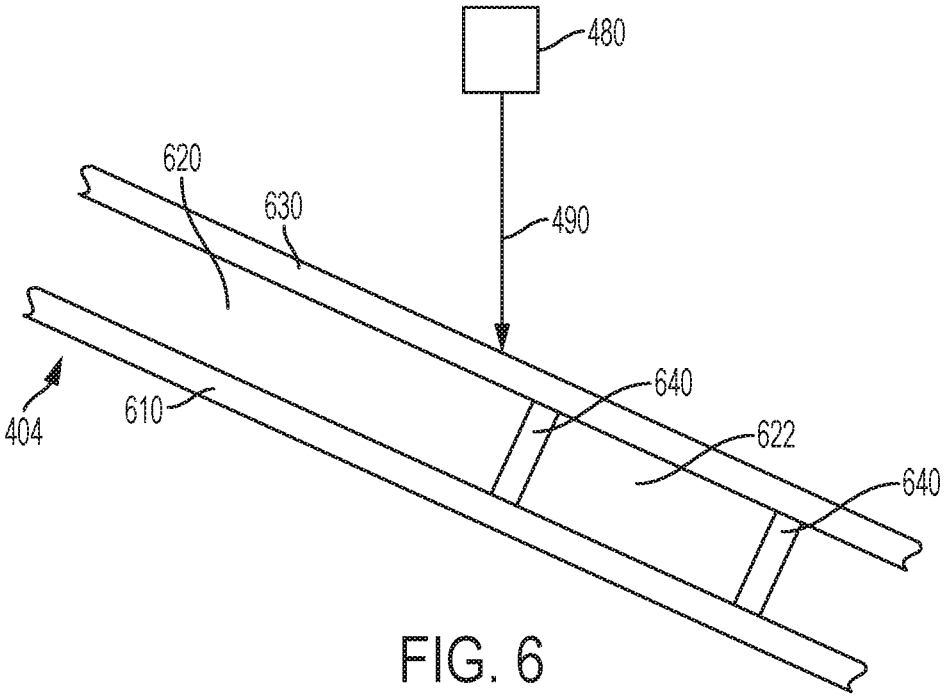
FIG. 6 is a schematic view of marking material cracking in accordance with exemplary embodiments of the disclosure.

FIG. 6 shows the cracking of the edges of a metal foil in accordance with the first embodiment shown in FIG. 4. When ribbon 404 is subjected to laser pulses 490, metallic layer 620 breaks at areas 640 that represent the edges of the marking portion 622. In this example, ribbon 404 has a laser clear layer 630 and a tie layer 610 that border metallic layer 620.

Figure 7:
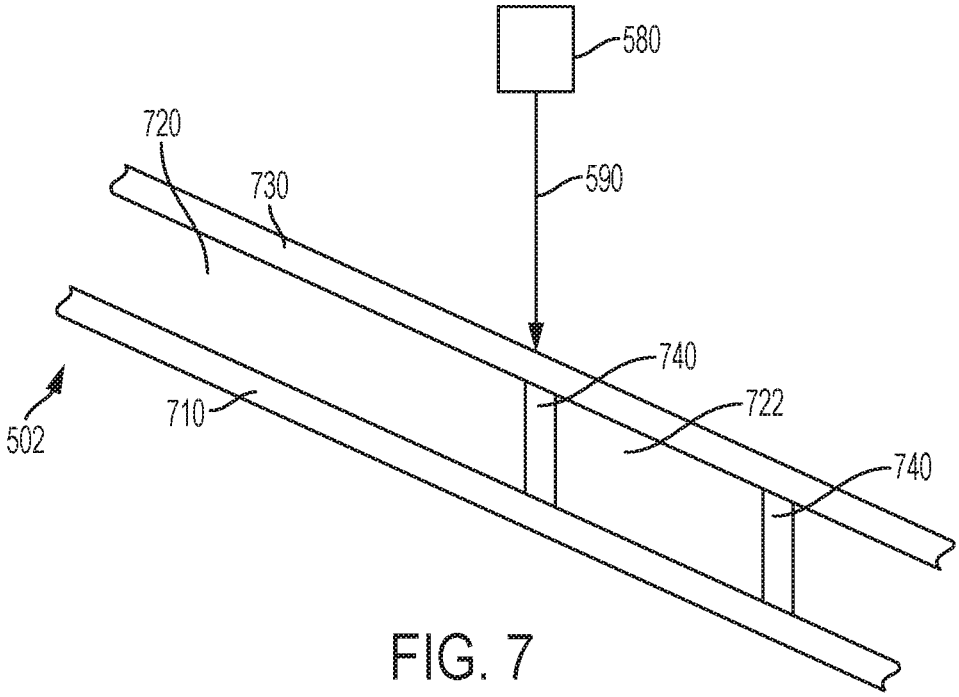
FIG. 7 is a schematic view of marking material melting in accordance with exemplary embodiments of the disclosure.

FIG. 7 shows the melting of the edges of a metallic matrix in accordance with the second embodiment shown in FIG. 5. When ribbon 502 is subjected to laser pulses 590, metallic matrix 720 melts at areas 740 that represent the edges of the marking portion 722. In this example, ribbon 502 has a laser clear layer 730 and a tie layer 710 that border metallic matrix 720.

Figure 8:
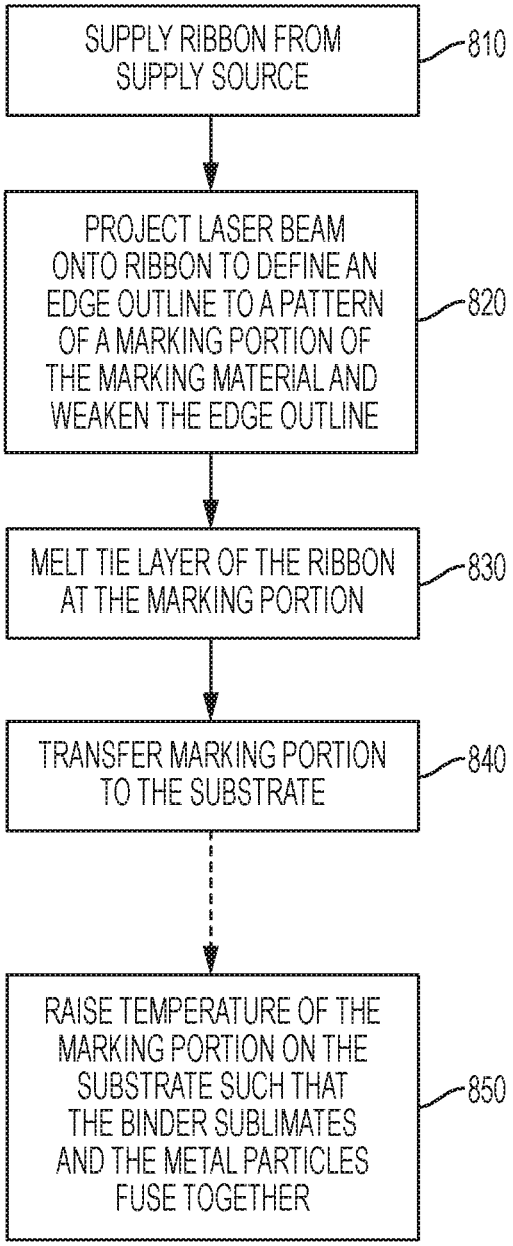
FIG. 8 is a diagram of an example of a method in accordance with embodiments of the disclosure.

FIG. 8 shows an example of a method in accordance with embodiments of the disclosure. At 810 a ribbon is supplied from a supply source. At 820 a laser beam is projected onto the ribbon to define an edge outline to a pattern of a marking portion of the marking material and weaken the edge outline. In the first embodiment, this weakening is the cracking of the metal layer. In the second embodiment, this weakening is the melting of the metallic matrix. At 830 the tie layer is melted below the marking portion. At 840 the marking portion of the marking material is transferred to the substrate. Action 850 applies to the second embodiment. At 850 the temperature of the marking portion on the substrate is raised such that the binders sublimate and the metallic particles fuse together.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A system for transferring a marking material from a ribbon to a substrate, the ribbon having a marking material and a tie layer, the system comprising:

a ribbon take-up device;

a ribbon supply source that supplies the ribbon to the ribbon take-up device such that the ribbon is moved in a process direction;

a first laser beam source configured to project a laser beam onto the ribbon to define an edge outline to a pattern of a marking portion of the marking material of the ribbon, the marking portion being a portion of the marking material of the ribbon that is to be transferred to the substrate, the first laser beam source being configured to create a weakening of the edge outline; and a heating unit configured to melt the tie layer of the ribbon at the marking portion, the melting taking place at a location where the ribbon is in contact with the substrate, the heating unit being configured to melt the tie layer such that the marking portion transfers to the substrate.

2. The system of claim 1, wherein the heating unit and the first laser beam source are located at different locations in the process direction.

3. The system of claim 2, further comprising a pressure roll located between the ribbon supply source and the ribbon take-up device in the process direction, the pressure roll being configured to apply pressure to the ribbon at a pressure location when the ribbon is positioned between the pressure roll and the substrate, wherein the heating unit is a second laser beam source that directs a plurality of laser beams through the pressure roll and onto the ribbon at the pressure location.

4. The system of claim 3, wherein the second laser beam source is a digitally addressable laser beam source that is stationary in a direction perpendicular to the process direction.

5. The system of claim 4, further comprising the ribbon, wherein the marking material of the ribbon is a metal film that is under tensile stress when the ribbon passes by the first laser beam source, and the first laser beam source is configured to rapidly shock the metal film along the edge outline such that the marking portion separates from a remaining portion of the marking material, the remaining portion of the marking material being that portion of the marking material that is not the marking portion.

6. The system of claim 5, wherein the metal film is greater than or equal to 0.3 micrometers thick.

7. The system of claim 4, further comprising the ribbon, wherein the marking material of the ribbon is a metallic paste matrix having metallic particles dispersed within a binder, the binder having a melting temperature that is higher than or equal to a melting temperature of the tie layer, and the first laser beam source is configured to melt the binder along the edge outline such that the marking portion separates from a remaining portion of the marking material, the remaining portion of the marking material being that portion of the marking material that is not the marking portion.

8. The system of claim 7, wherein the marking portion is greater than or equal to 0.3 micrometers thick.

9. The system of claim 7, further comprising a third laser beam source located downstream in the process direction from the second laser beam source, the third laser beam source raises the temperature of the marking portion such that the binder in the marking portion sublimates and the metallic particles in the marking portion fuse to each other.

10. The system of claim 4, further comprising a third laser beam source located downstream in the process direction from the second laser beam source, the third laser beam source being configured to raise the temperature of the marking portion such that a binder in the marking portion sublimates and metallic particles in the marking portion fuse to each other.

11. A method of transferring a marking material from a ribbon to a substrate, the ribbon having a marking material and a tie layer, the method comprising:

supplying a ribbon from a supply source to a ribbon take-up device such that the ribbon is moved in a process direction;

projecting a laser beam from a first laser beam source onto the ribbon to define an edge outline to a pattern of a marking portion of the marking material of the ribbon, the marking portion being a portion of the marking material of the ribbon that is to be transferred to the substrate, the first laser beam source creating a weakening of the edge outline; and melting the tie layer of the ribbon at the marking portion with a heating unit, the melting taking place at a location where the ribbon is in contact with the substrate, the heating unit melting the tie layer such that the marking portion transfers to the substrate.

12. The method of claim 11, wherein the heating unit and the first laser beam source are located at different locations in the process direction.

13. The method of claim 12, further comprising apply pressure to the ribbon at a pressure location when the ribbon is positioned between a pressure roll and the substrate, the pressure roll being located between the ribbon supply source and the ribbon take-up device in the process direction, wherein the heating unit is a second laser beam source that directs a plurality of laser beams through the pressure roll and onto the ribbon at the pressure location.

14. The method of claim 13, wherein the second laser beam source is a digitally addressable laser beam source that is stationary in a direction perpendicular to the process direction.

15. The method of claim 14, wherein the marking material of the ribbon is a metal film that is under tensile stress when the ribbon passes by the first laser beam source, and the first laser beam source rapidly shocks the metal film along the edge outline such that the marking portion separates from a remaining portion of the marking material, the remaining portion of the marking material being that portion of the marking material that is not the marking portion.

16. The method of claim 15, wherein the metal film is greater than or equal to 0.3 micrometers thick.

17. The method of claim 14, wherein the marking material of the ribbon is a metallic paste matrix having metallic particles dispersed within a binder, the binder having a melting temperature that is higher than or equal to a melting temperature of the tie layer, and the first laser beam source melts the binder along the edge outline such that the marking portion separates from a remaining portion of the marking material, the remaining portion of the marking material being that portion of the marking material that is not the marking portion.

18. The method of claim 17, further comprising raising the temperature of the marking portion with a third laser beam source such that the binder in the marking portion sublimates and the metallic particles in the marking portion fuse to each other, the third laser beam source being located downstream in the process direction from the second laser beam source.

19. The method of claim 14, further comprising raising the temperature of the marking portion with a third laser beam source such that a binder in the marking portion sublimates and metallic particles in the marking portion fuse to each other, the third laser beam source being located downstream in the process direction from the second laser beam source.

20. The method of claim 14, wherein the ribbon comprises a thick metal ribbon material with CuO nanoparticles at approximately 80% by weight that is held together with a binding matrix of Cyclododecane wax, wherein the nanoparticles have melting temperatures that enable photonic curing by pulse forging, and the nanoparticles are dispersible in aqueous or solvent based solutions and supplied in pasted flexo or screen printable formulations that are miscible with a binding agent and capable of being deposited uniformly onto a thermal transfer ribbon.

* * * * *